US005206689A

United States Patent [19]

Kusuda

[11] Patent Number: 5,206,689

[45] Date of Patent: Apr. 27, 1993

[54] COPY RATIO SETTING APPARATUS

[75] Inventor: Yasuhiro Kusuda, Osaka, Japan

[73] Assignee: Minolta Camera Kabushiki Kaisha, Osaka, Japan

[21] Appl. No.: 341,713

[22] Filed: Apr. 21, 1989

[30] Foreign Application Priority Data

| | | | |
|---|---|---|---|
| Apr. 22, 1988 | [JP] | Japan | 63-100886 |
| Oct. 17, 1988 | [JP] | Japan | 63-262522 |
| Oct. 17, 1988 | [JP] | Japan | 63-262523 |

[51] Int. Cl.[5] ..... G03G 15/04

[52] U.S. Cl. ..... 355/243; 355/55; 355/309

[58] Field of Search ..... 355/243, 230, 56, 55, 355/309

[56] References Cited

U.S. PATENT DOCUMENTS

| | | | |
|---|---|---|---|
| 3,914,043 | 10/1975 | McVeigh | 355/326 |
| 4,277,163 | 7/1981 | Ikesue et al. | 355/243 |
| 4,505,579 | 3/1985 | Furuichi | 355/55 |
| 4,669,858 | 6/1987 | Ito et al. | 355/243 |
| 4,745,443 | 5/1988 | Adachi et al. | 355/55 X |
| 4,752,809 | 1/1988 | Ito | 355/218 |

FOREIGN PATENT DOCUMENTS

| | | | |
|---|---|---|---|
| 3512845 | 10/1985 | Fed. Rep. of Germany | 355/243 |
| 0104919 | 6/1982 | Japan | 355/56 |
| 59-147337 | 8/1984 | Japan . | |
| 0205928 | 9/1986 | Japan | 355/56 |
| 2160988 | 1/1986 | United Kingdom | 355/56 |

*Primary Examiner*—A. T. Grimley
*Assistant Examiner*—Robert Beatty
*Attorney, Agent, or Firm*—Burns, Doane, Swecker & Mathis

[57] ABSTRACT

An image forming apparatus provides for the scanning of an original document when placed on a document table. The scanning operation moves from a predetermined position along a predetermined scanning direction. A specifying arrangement for specifying an original document area is provided which is movable along one side of the document table along with a second specifying arrangement for specifying a copy area which is also movable in parallel with the side of the document table. Both specifying arrangements include magnetic members. A detector is incorporated with the scanner so as to detect positions of the specifying arrangements. Signals are generated when the detector detects the magnetic members of the specifying arrangements during the scanning operation. A copy ratio is then computed based on a comparison of the signals which have been detected so that an image is formed which corresponds to the document and the computed copy ratio.

5 Claims, 11 Drawing Sheets

COPY RATIO SETTING APPARATUS

BACKGROUND OF THE INVENTION (1) Field of the Invention

The present invention refers to a copy ratio (magnification or reduction ratio) setting apparatus and method for use in image forming apparatus such as copiers and printers.

(2) Description of the Related Art

In a conventional copier equipped with an automatic copy ratio selecting function, a document size and a paper size are found by detecting means so as to determine the optimum copy ratio, thereafter a copying operation is executed with the above copy ratio. According to the above method, however, the size of a document image is not considered at all for obtaining the copy ratio. Therefore, a document with a large margin is inevitably duplicated into a copy with a large margin. There has been a demand that a document with a large margin be duplicated into a copy with a smaller margin, which is not accomplished by this method.

SUMMARY OF THE INVENTION

Accordingly, this invention has a first object of offering a copying apparatus and method where even a document with a large margin is duplicated into a copy with the smallest possible margin.

A second object of this invention is to offer a copy ratio setting apparatus and method where a copy ratio is determined based on the size of a document image to copy, not on the size of a document itself.

A third object of this invention is to offer a copy ratio setting apparatus and method where an area of a document image to copy and the size of another area which the document image is to be copied into are easily specified while they are visually confirmed.

A fourth object of this invention is to offer a copying apparatus and method where an appropriate size of paper is selected for obtaining a duplicated copy with the smallest possible margin.

The first, second and third objects are fulfilled by a copy ratio setting apparatus comprising a rectangular document table; first specifying means, which is movable in parallel with one side of the document table; second specifying means, which is movable in parallel with the same side of the document table; first signal generating means for generating a first signal corresponding to the position of the first specifying means; second signal generating means for generating a second signal corresponding to the position of the second specifying means; and computing means for computing a copy ratio based on the first and the second signals.

The above objects are also fulfilled by a copying apparatus comprising a rectangular document table; first specifying means, movable in parallel with one side of the document table, for specifying an area of a document image to copy on the document table; second specifying means, movable in parallel with the same side of the document table, for specifying the size of another area which the document image is to be copied into; scanning means for scanning the area specified by the first specifying means; detecting means, movably incorporated with the scanning means, for detecting the positions of the first and second specifying means; signal generating means for, based on detection signals sent from the detecting means, generating a first signal corresponding to the position of the first specifying means and a second signal corresponding to the position of the second specifying means; computing means for computing a copy ratio based on the first and the second signals; and image forming means for forming another image corresponding to the document image read by the scanning means on a paper with the above copy ratio.

The first specifying means may have a first magnet, the second specifying means may have a second magnet, the first signal generating means may have a first detecting element for detecting the first magnet and may generate the first signal based on the output from the first detecting element, and the second signal generating means may have a second detecting element for detecting the second magnet and may generate the second signal based on the output from the second detecting element.

The above objects are also fulfilled by a copy ratio setting method using first and second specifying means movable in parallel with one side of a rectangular document table, comprising the steps of detecting the position of the first specifying means, which specifies an area of a document image to copy, for generating a first signal; detecting the position of the second specifying means, which specifies the size of another area which the document image is to be copied into, for generating a second signal; and computing a copy ratio based on the first and the second signals.

In the above construction and method, a copy ratio is determined in the following way. The first specifying means is manually moved to specify the rear end of an area of a document image to copy, and the second specifying means is manually moved to specify the size of another area which the document image is to be copied into. Since the optical scanning means moves after that, the first detecting means detects the position of the first specifying means, and the second detecting means detects the position of the second specifying means. The detection signals from the first and the second detecting means are sent to the computing means. The computing means finds X (distance between the leading end of the document and the position of the first specifying means) and Y (distance between the leading end of the document and the second specifying means), further finds Y/X, and sets it as the magnification ratio. The image forming means is driven in accordance with Y/X.

As described above, according to this invention, the copy ratio is determined by moving the first and the second operation members, requiring no preparatory calculation. Further, the document image area to copy and the size of the area which the document image is to be copied into are visually confirmed. As a result, a copier very easy to use is obtained. Since the copy ratio is determined based on the size of the document image area, not on the size of the document itself, a duplicated copy with the smallest possible margin is obtained.

The fourth object is fulfilled by a copying apparatus comprising a rectangular document table; specifying means, movable in parallel with one side of the document table, for specifying an area of a document image to copy on the document table; scanning means for scanning the area specified by the first specifying means; detecting means, movably incorporated with the scanning means, for detecting the position of the specifying means; signal generating means for generating a first signal based on the output from the detecting means; paper size detecting means for detecting the size of a paper and generating a second signal based on the detected paper size; computing means for computing a copy ratio based on the first and the second signals; and image forming means for forming another image corresponding to the document image read by the scanning means on the paper with the above copy ratio.

The signal generating means may have pulse signal generating means and may generate the first signal in accordance with the number of pulses which are generated between a predetermined time and another time when the detecting means detects the specifying means.

The copying apparatus may further comprise multiple paper feeding means and selecting means for selecting one of the paper feeding means, in which the size of the paper is detected by detecting means.

The above object is also fulfilled by a copying apparatus comprising a rectangular document table; first specifying means, movable in parallel with one side of the document table, for specifying an area of a document image to copy on the document table; second specifying means, movable in parallel with the same side of the document table, for specifying the size of another area which the document image is to be copied into; first signal generating means for generating a first signal corresponding to the position of the first specifying means; second signal generating means for generating a second signal corresponding to the position of the second specifying means; computing means for computing a copy ratio based on the first and the second signals; multiple paper feeding means; paper size detecting means for detecting the size of a paper in each of the paper feeding means; selecting means for selecting one of the paper feeding means based on the second signal; and image forming means for forming another image corresponding to the document image onto the paper fed from the selected paper feeding means with the above copy ratio.

The first specifying means may have a first magnet, the second specifying means may have a second magnet, the first signal generating means may have a first detecting element for detecting the first magnet and may generate the first signal based on the output from the first detecting element, and the second signal generating means may have a second detecting element for detecting the second magnet and may generate the second signal based on the output from the second detecting element.

The copying apparatus may further comprise warning means for warning that the size of the area which the document image is to be copied into is bigger than the size of the paper in any of the paper feeding means.

In the above construction, the copy ratio is determined before the image forming means is operated. The area of the document image to copy is specified by the specifying means and the paper size is detected by the paper size detecting means, whereby the optimum copy ratio is obtained.

When multiple paper feeding means are provided, each of which has different size of paper, one of the paper feeding means is selected by selecting means. The optimum copy ratio is found based on the size of the paper in the selected paper feeding means and the document image area specified by the specifying means.

After the optimum copy ratio is found and the selected paper feeding means is driven to feed paper, the image forming means forms an image with the above copy ratio. As a result, a duplicated copy with the smallest margin is obtained.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF A PREFERRED EMBODIMENT

Figure 1:
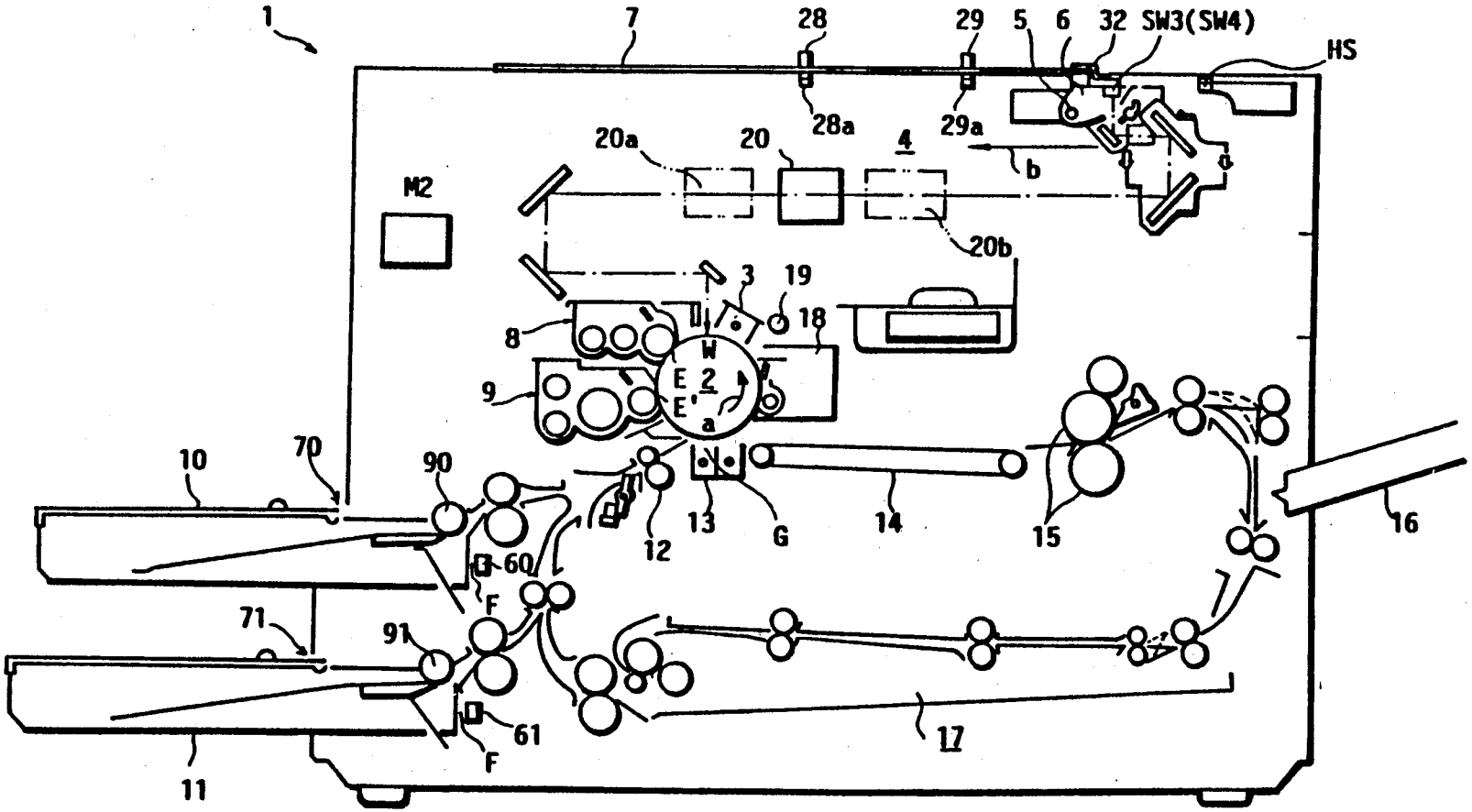
FIG. 1 shows an internal construction of a copier 1 according to the present invention in a simplified form.

FIG. 1 shows an internal construction of a copier 1 according to the present invention in a simplified form. The general construction of the copier 1 will be explained below along with its equal-size copying operation.

The copier 1 has an upper and a lower feeding inlets 70 and 71 at one side thereof (the left side in FIG. 1), and cassettes 10 and 11 are detachably inserted into the above inlets 70 and 71, respectively. On the leading side of each cassette is a code F, indicating which size of paper is held in the cassette and whether the paper is set in parallel with or perpendicularly to the paper feeding direction. Provided in the vicinity of the leading side of each cassette is a paper size detection sensor 60 or 61 for reading the code F. The paper sizes accepted by the copier 1 are, for example, A3, A4, A5, B4 and B5. A4 and B5 can be fed both perpendicularly to and in parallel with the paper feeding direction.

The operation of the copier 1 will be described below.

While a photoconductive drum 2 is rotating in the direction of an arrow a, a main charger 3 provides the surface of the photoconductive drum 2 with a certain electric charge.

An optical system 4 operates as follows. A scanner 6 equipped with an exposure lamp 5 irradiates light on a document through a rectangular glass document table 7 while scanning in the direction of another arrow b. The light is scattered on the document and travels along mirrors and a magnification lens 20 until it reaches the exposure point W, where the surface of the photoconductive drum 2 is exposed. As a result, an electrostatic latent image corresponding to an image of the document is formed on the photoconductive drum 2.

The electrostatic latent image is given toner in a developing area E or E' by a first developing device 8 or a second developing device 9. In consequence, a toner image corresponding to the document image is formed.

As for paper feeding, either the cassette 10 or 11 is selected, and the paper in the selected cassette is fed by the rotation of a feeding roller near the selected cassette, that is 90 or 91. Then, the paper is timed with the rotation of the photoconductive drum 2 by a pair of timing rollers 12 and is transported to a transfer area G by a transfer charger 13. Here, the toner image is transferred onto the paper. Then, the paper is transported by a transporting belt 14 to pass between a pair of rollers 15, where the paper has the toner image heat-fixed. After that, the paper is delivered onto a delivery tray 16.

If the copier 1 is in the duplex copying mode, the paper is transported to a duplex device 17 instead of delivered. Here, the paper is reversed and again transported to the transfer area G. The optical system 4 and the photoconductive drum 2 repeat the above-mentioned operation. This time, an image is transferred on the reverse side of the paper.

The residual toner on the photoconductive drum 2 is scratched off by a cleaning device 18, and the residual electric charge is erased by the light from an eraser lamp 19. Now, the photoconductive drum 2 is ready for another image forming.

Figure 2:
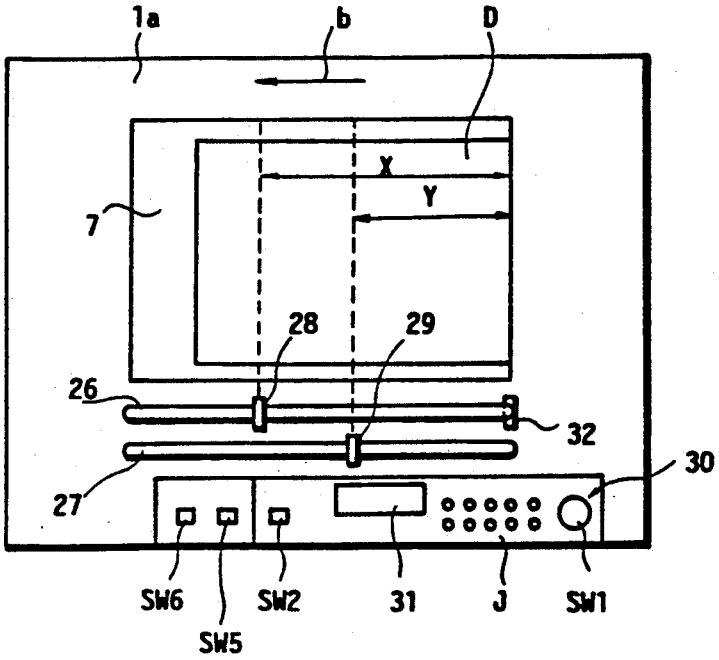
FIG. 2 is a top view of the same.
Figure 3A:
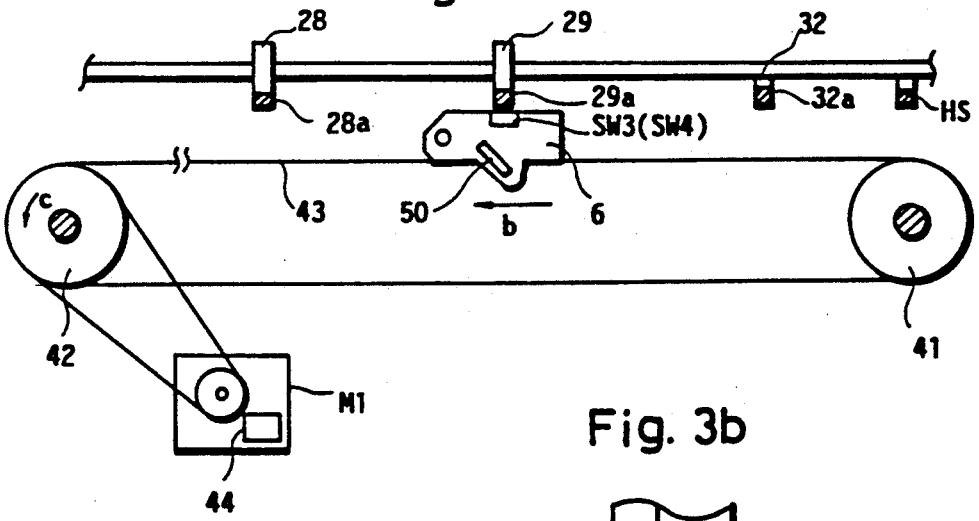
FIG. 3*a* is a schematic side view of a scanner 6 and its vicinity.
Figure 3B:
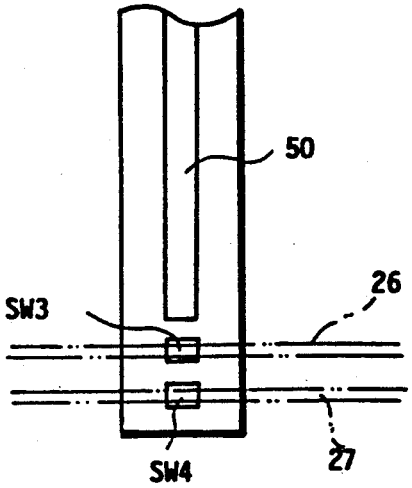
FIG. 3*b* is an enlarged plan view of the scanner 6.

FIG. 2 is a top view of the copier 1, FIG. 3*a* shows a schematic side view of the scanner 6 and its vicinity, and FIG. 3*b* is an enlarged plan view of the scanner 6. As also shown in FIG. 1, the copier 1 has the transparent glass document table 7 on its upper surface 1*a*. Below the glass document table 7 in FIG. 2 are guide grooves 26 and 27 running in parallel with one side of the document table 7 and also with the arrow b. A first operation member 28, which is movable along the guide groove 26, is used to specify the rear end of a document D, more specifically, of an area of a document image to copy. A second operation member 29, which is movable along the guide groove 27, is used to specify the size of another area which the document image is copied into (referred to as duplicated copy size hereinafter).

An operation panel 30 is provided below the guide groove 27 in FIG. 2. The operation panel 30 has a print switch SW1 for starting a duplication operation, a magnification mode setting switch SW2 for putting the copier 1 into the magnification mode, a magnification sub-mode selection switch SW5 for selecting one among a first, a second and a third magnification sub-modes when the copier 1 is in the magnification mode, a paper size selection switch SW6 for selecting the paper either in the upper cassette 10 or the lower cassette 11, a set of ten keys J for inputting 0 through 9, and a display window 31 for displaying, for example, the commanded number of copies, magnification ratio, and a warning that the appropriate size of paper is not loaded for the magnification. In describing this embodiment, "magnification" means to copy with a copy ratio of more than 1 or of less than 1. In the first magnification sub-mode, the document image area specified by the first operation member 28 is copied into the duplicated copy size specified by the second operation member 29 on the size of paper selected by the paper size selection switch SW6. In the second magnification sub-mode, the size of the document image area specified by the first operation member 28 and the paper size selected by the paper size selection switch SW6 are used to calculate the optimum magnification ratio, with which the document image is copied on the selected size of paper with the smallest possible margin. In the third magnification sub-mode, the duplicated copy size specified by the second operation member 29 is used to automatically select the cassette holding the optimum size of paper, on which the document image area specified by the first operation member 28 is copied with the smallest possible margin. If the duplicated copy size is bigger than the paper size in either of the cassettes in the third magnification sub-mode, a warning is displayed.

The copier 1 is put into the magnification mode by pushing the magnification mode setting switch SW2. Each time SW2 is pushed, it is switched on or off alternately. Pushing the magnification sub-mode selection switch SW5 selects one of the three magnification sub-modes. Each time SW5 is pushed, the magnification sub-mode is cycled from the first to the second to the third to the first.

The guide groove 26 has, at its end corresponding to the leading end of the paper, a fixed member 32, which projects downward. The first and the second operation members 28 and 29 and the fixed member 32 respectively have permanent magnets 28*a*, 29*a* and 32*a* adhered on the lower ends thereof. The scanner 6 has a first lead switch SW3 and a second lead switch SW4 arranged perpendicularly to the arrow b on the upper surface thereof. The first lead switch SW3, as first detection means, detects the permanent magnets 32*a* and 28*a*, whereby to detect the fixed member 32 and the first operation member 28. The second lead switch SW4, as second detection means, detects the permanent magnets 29*a*, whereby to detect the second operation member 29. As shown in FIG. 3*b*, the first and the second lead switches SW3 and SW4 are provided in the manner that they do not block the light scattered from the document D to a mirror 50 inside the scanner 6. Another permanent magnet HS is provided on the reverse surface of an upper plate of the copier 1 for indicating the home position of the scanner 6.

The scanner 6 is connected to an endless wire 43 travelling between the a driving pulley 42 and a following pulley 41. The driving pulley 42 is driven by a motor M1, which is equipped with an encoder 44.

Figure 4:
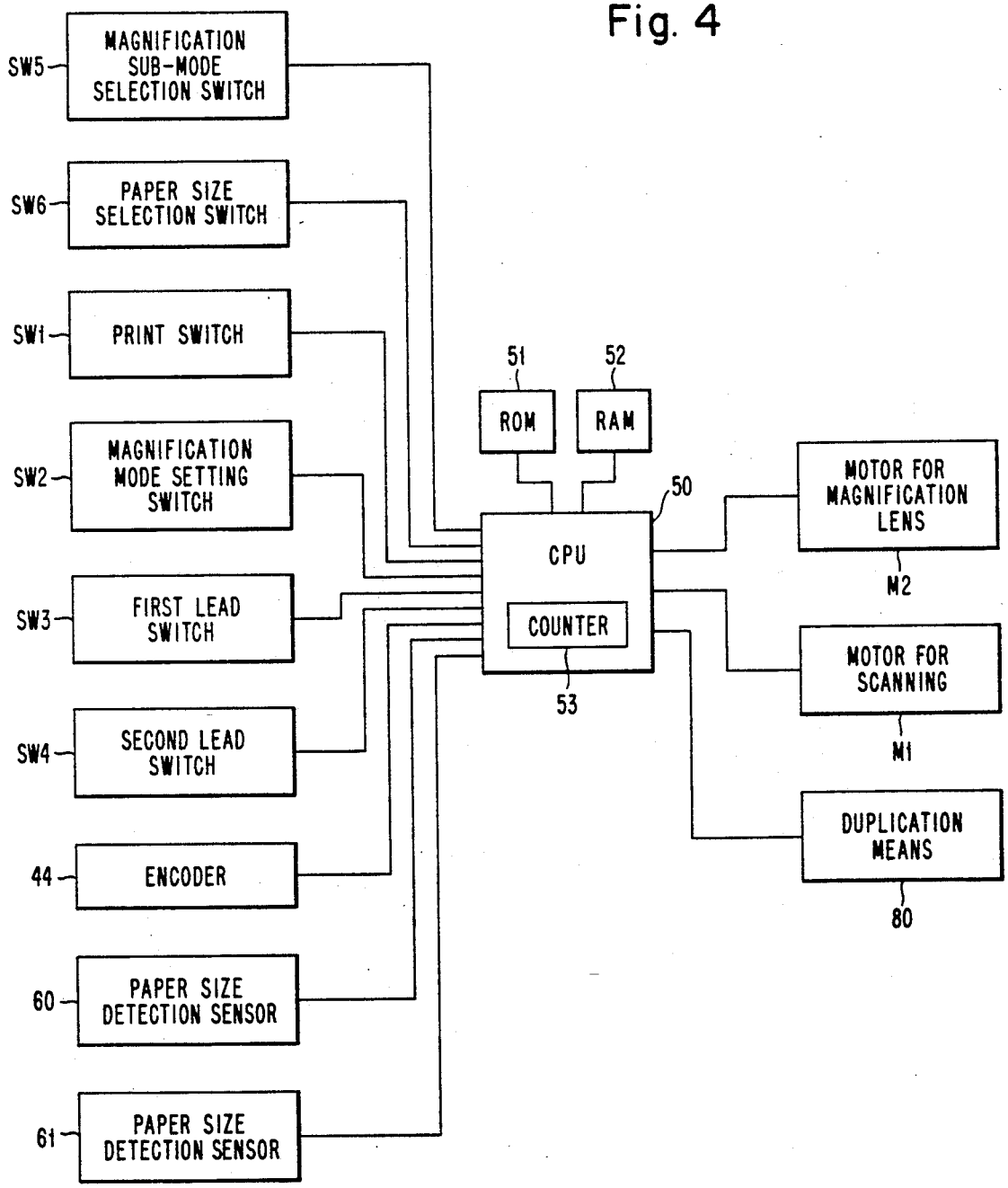
FIG. 4 is a block diagram showing an electric construction concerning magnification.

FIG. 4 is a block diagram of the electric construction concerning the magnification operation. Signals from the print switch SW1, the magnification mode setting switch SW2, the magnification sub-mode selection switch SW5 and the paper size selection switch SW6 are sent to a CPU 50. Detection signals from the first lead switch SW3, the second lead switch SW4 and the paper size detection sensors 60 and 61 are also sent to the CPU 50. Pulse signals which are output from the encoder 44 in accordance with the rotation angle of the motor M1 are also sent to the CPU 50. The CPU 50 is connected to a read-only memory (referred to as ROM hereinafter) 51 and to a random access memory (referred to as RAM hereinafter) 52. The CPU 50 is equipped with a counter 53, which executes the counting operation in accordance with the pulse signals sent from the encoder 44. The CPU 50 is also connected to duplication means 80, a motor M2 for driving the magnification lens 20, and the motor M1. The CPU 50 controls the driving of the motors M1 and M2 in accordance with the magnification ratio, while controlling the duplication means 80, whereby to execute the duplication operation with the above magnification ratio.

Figure 5:
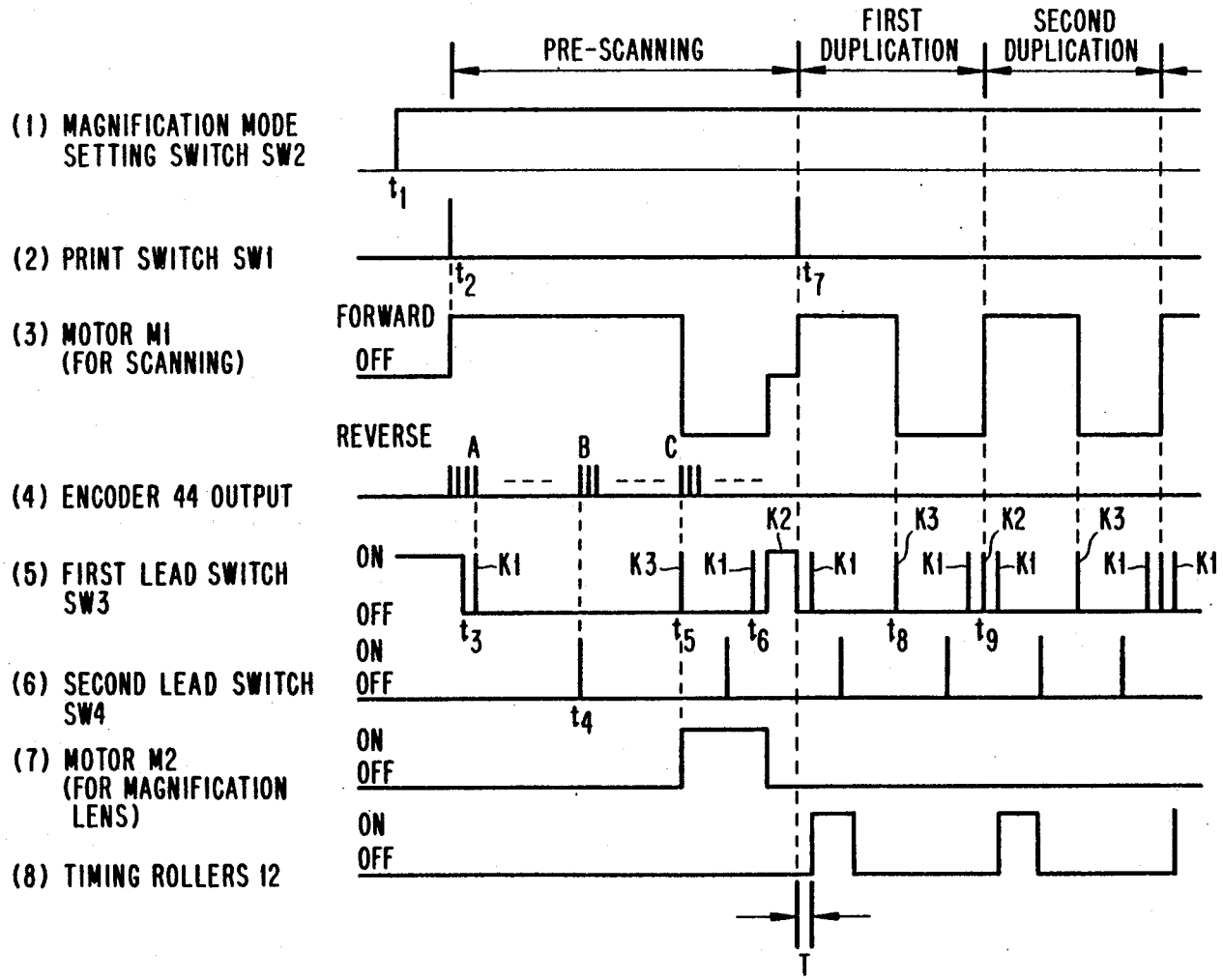
FIG. 5 is a timing chart of a copying operation with the magnification ratio of less than 1.

Referring to FIG. 5, the magnification mode setting operation will be described. Here, the magnification ratio is to be less than 1. First of all, the document D is placed on the document table 7, with its leading end aligned with the leading end of the document table 7 as shown in FIG. 2. Then, as in FIG. 5(1), the magnification mode setting switch SW2 is turned on at time $t_1$, whereby the copier 1 goes into the magnification mode. The magnification sub-mode selection switch SW5 is pushed to select one of the three magnification sub-modes. When necessary, the paper size selection switch SW6 is operated to select the appropriate paper size. Thereafter, the first operation member 28 is moved to specify the rear end of an area of a document image to copy, and the second operation member 29 is moved to specify the rear end of a duplicated copy size. In this way, the magnification ratio is determined. As shown in FIG. 5(2), the print switch SW1 is turned on at time $t_2$, whereby the motor M1 for scanning is driven to rotate forward at time $t_2$ as shown in FIG. 5(3). At this time, the copier 1 goes into the pre-scanning status, where the duplication means 80 is stopped and only the scanner 6 operates. At time $t_2$, the motor M1 is driven and so the pulley 42 is rotated in the direction of an arrow c, whereby the scanner 6 moves from its home position in the direction of the arrow b. As shown in FIG. 5(4), the rotation of the motor M1 urges the encoder 44 to start outputting pulse signals after time $t_2$, whereby the counter 53 starts counting. The encoder 44 thus acts as a reference signal generator. The scanner 6 reaches the leading end of the document D at time $t_3$, when the first lead switch SW3 detects the permanent magnet **32*a* and outputs a detection signal as shown in FIG. 5(5). At this time, the CPU 50 reads the value K of the counter 53 at time $t_3$ and stores it in area A of the RAM 52. (The value K stored in area A will be referred to as value A hereinafter.) In FIG. 5(5), K1, K2 and K3 respectively indicate the detection signals which are output when the permanent magnets 32*a*, HS and 28*a* are detected. The scanner 6 reaches the second operation member 29 at time $t_4$, when the second lead switch SW4 detects the permanent magnet 29*a* and outputs a detection signal as shown in FIG. 5(6). At this time, the CPU 50 reads the value K of the counter 53 at time $t_4$ and stores it in area B of the RAM 52. (The value K stored in area B will be referred to as value B, a reference signal, hereinafter.) The scanner 6 reaches the first operation member 28 at time $t_5$, when the first lead switch SW3 detects the permanent magnet 28*a* and outputs a detection signal as shown in FIG. 5(5). At this time, the CPU 50 reads the value K of the counter 53 at time $t_5$ and stores it in area C of the RAM 52. (The value K stored in area C will be referred to as value C hereinafter.) Thereafter, the CPU 50 reads the values A, B and C out of the RAM 52 and calculates N1 and N2. N1 is the number of pulses which are output from the encoder 44 after the permanent magnet 32*a* is detected until the permanent magnet 29*a* is detected, namely B−A. N2 is the number of pulses which are output from the encoder 44 after the permanent magnet 32*a* is detected until the permanent magnet 28*a* is detected, namely C−A. Then, Y and X are found from N1, N2, and the pulse interval. X is the distance between the leading end of the document and the position of the first operation member 28, namely the distance in the feeding direction (referred to as length hereinafter) of the document image area. Y is the distance between the leading end of the document and the position of the second operation member 29**, namely the length of the duplicated copy size. They are used to find the optimum magnification ratio.

When the third one among the detection signals sent from the first and the second lead switches SW3 and SW4 (the second one sent from the first lead switch SW3 in this case) is output, the motor M1 is rotated in reverse. Therefore, the pulley 42 is rotated in the opposite direction from the arrow c, and the scanner 6 is moved in the opposite direction from the arrow b. The scanner 6 comes back to its home position at time $t_6$, when the motor M1 is stopped. The period between $t_5$ and $t_6$ is much shorter than that between $t_2$ and $t_5$. In other words, the reverse run of the scanner 6 is much faster than its forward run.

In the above, the magnification ratio is to be less than 1. If it is to be more than 1, the second operation member 29 in FIG. 2 will be to the left of the first operation member 28 in FIG. 2. Therefore, the value C is read before the value B is. The scanner 6 starts returning when the value B is read, namely, when the second lead switch SW4 detects the permanent magnet **29*a***.

As has been described so far, X and Y are found during the pre-scanning period. On the other hand, the determination of the optimum magnification ratio and the selection of the appropriate paper size are executed after one of the magnification sub-modes is selected.

Between the pre-scanning and the main scanning periods, the CPU 50 drives the motor M2 to move the magnification lens 20 in parallel with the scanning direction. When the magnificaton ratio is to be less than 1, the magnification lens 20 at its equal-size copying position is moved downstream in the scanning direction to a chained box **20*a*. When the magnification ratio is to be more than 1, it is moved upstream to another chained box 20*b*. The distance between 20*a*, 20 and 20*b*** depends on the magnification ratio.

When the print switch SW1 is pushed at time $t_7$, the duplication means 80 including the photoconductive drum 2 is driven. The paper, which has been stopped by the timing rollers 12 during the pre-scanning period, is fed by the timing rollers 12 toward the transfer area G, after a predetermined time T. T, which is the period for aligning the leading end of the toner image on the photoconductive drum 2 and the leading end of the paper, is stored in the CPU 50. The motor M1 is rotated forward, whereby the scanner 6 is moved in the direction of the arrow b so as to scan the specified area of the document image. As soon as the first lead switch SW3 detects the permanent magnet **28*a*, (A8) the scanner 6 returns. The scanning speed of the scanner 6 is higher when the magnification ratio is to be less than 1, and is slower when the ratio is to be more than 1, compared with that during the equal-size copying. Provided the circumferential speed of the photoconductive drum 2 is v, the scanning speed of the scanner 6 is v/(Y/X) in the first and the third magnification sub-modes. The magnification lens 20** is moved in order to magnify the distance in the main scanning direction, and the scanning speed is changed in order to magnify the distance in the sub scanning direction, which is perpendicular to the main scanning direction.

For one-sheet copying, the duplication operation is completed when the scanner 6 comes back to its home position ($t_9$). For multiple copying, the operation from $t_7$ to $t_9$ are repeated for the commanded number of copies.

When Y/X exceeds the maximum magnification ratio of the copier 1, the above maximum magnification ratio is employed. When Y/X is less than the minimum magnification ratio, the minimum magnification ratio is employed.

Referring to FIGS. 6 through 13, the control operation of automatic magnification, especially of the first through third magnification sub-modes, will be detailed.

MAIN ROUTINE

Figure 6:
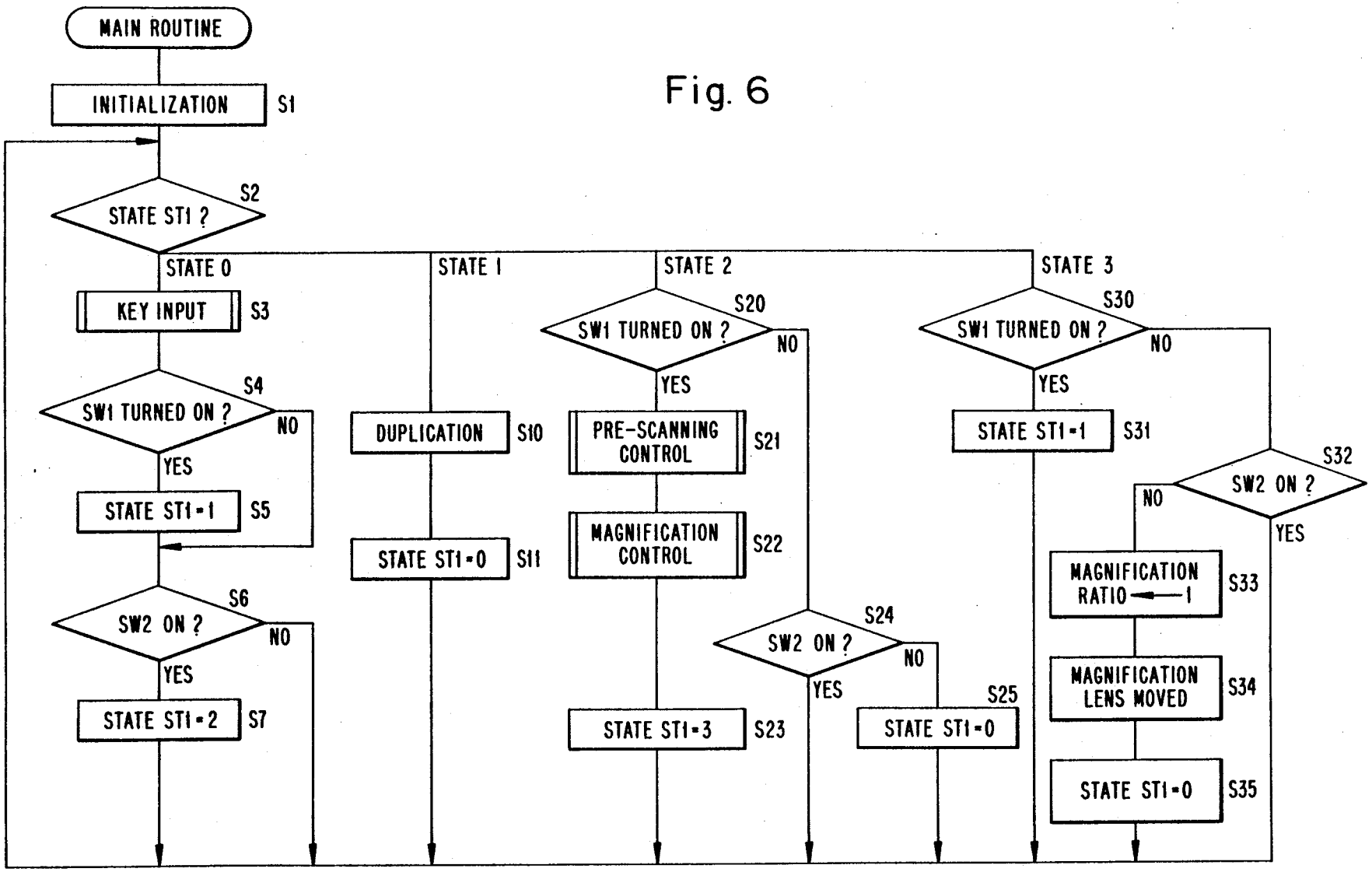
FIG. 6 is a flowchart showing the main routine of the copier 1.
Figure 7:
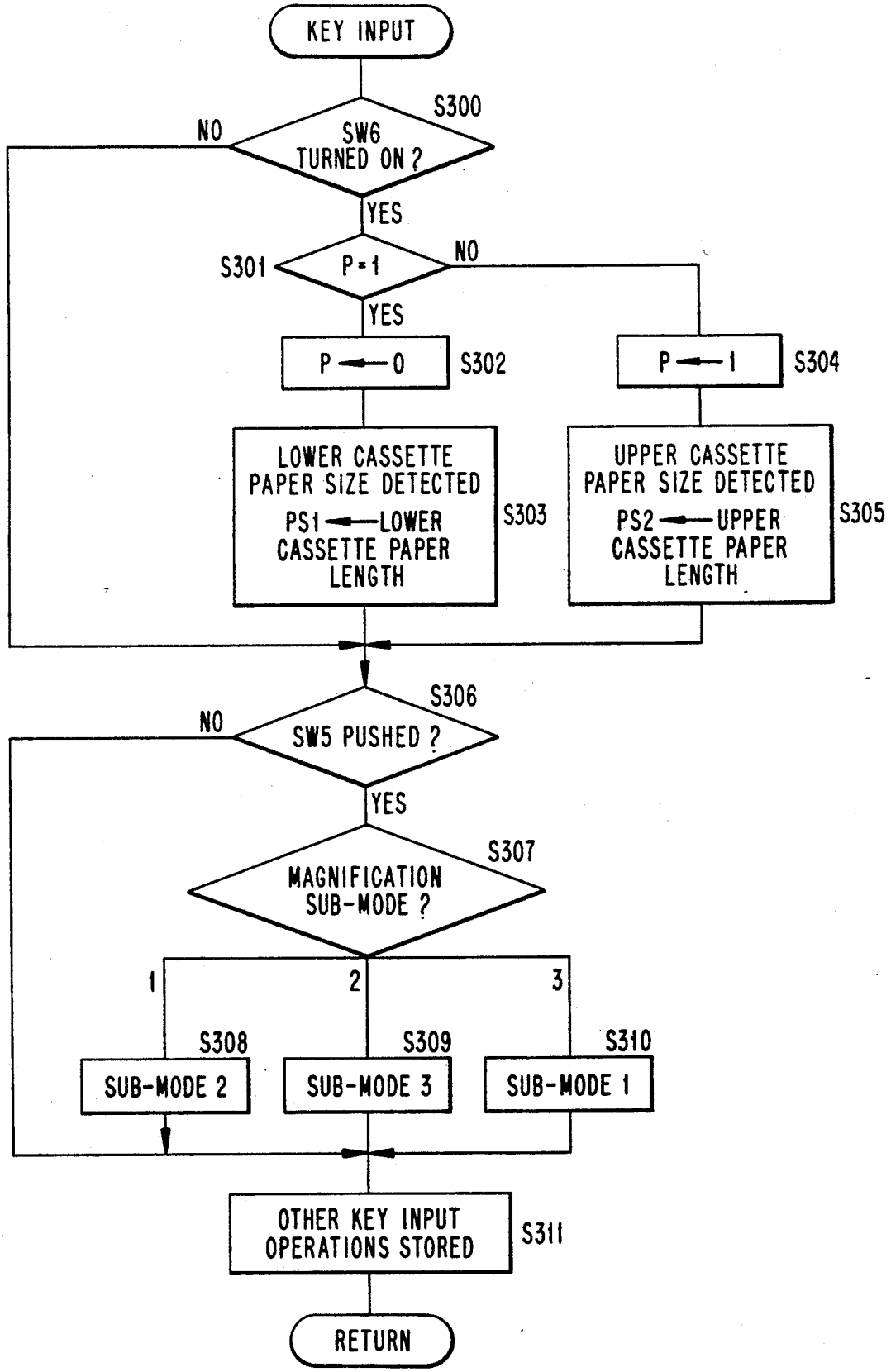
FIG. 7 is a flowchart showing the subroutine of key input.

FIG. 6 is a flowchart showing the main routine of the copier 1. In step S1, the copier 1 is initialized as follows. State ST1 is set 0, the magnification mode is set 0 (the magnification ratio is 1.0), and the lower cassette 11 is selected. The size of the paper in the lower cassette 11 is detected, and its length in the feeding direction is stored in the RAM 52. In S2, ST1 is judged. If ST1=0, the key input operation detailed in FIG. 7 is executed (S3), and then whether the print switch SW1 is turned on or not is judged (S4). If so, ST1 is set 1 (S5), and then the operation goes to S6. If not, the operation jumps to S6. In S6, whether the magnification mode setting switch SW2 is on or not is judged. If so (magnification copying), ST1 is set 2 (S7), and then the operation goes back to S2. If not (equal-size copying), the operation directly goes back to S2.

If ST1=1 in S2, the duplication operation is done (S10), ST1 is set 0 (S11), and then the operation goes back to S2. An equal-size copying is completed here.

Figure 8:
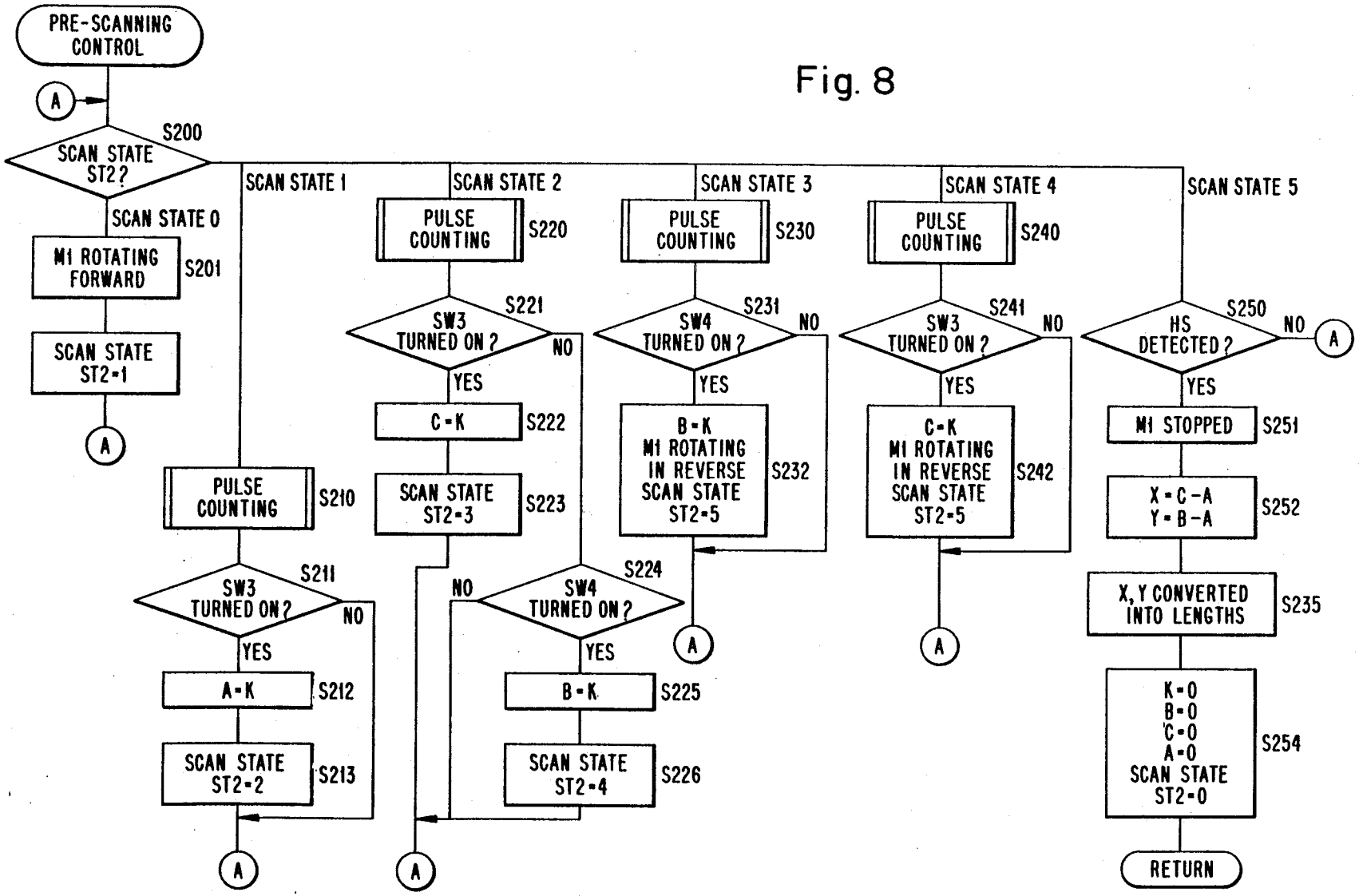
FIG. 8 is a flowchart showing the subroutine of prescanning control.
Figure 10:
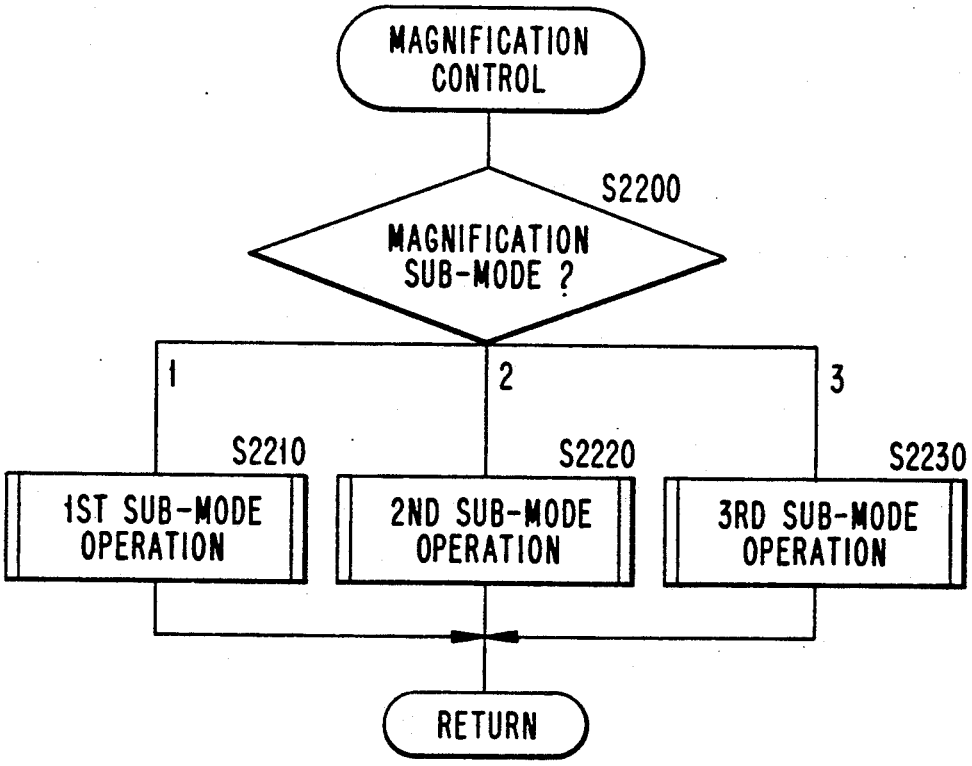
FIG. 10 is a flowchart showing the subroutine of magnification control.

If ST1=2 in S2, whether SW1 is turned on or not is judged (S20). If so, the pre-scanning control detailed in FIG. 8 is executed (S21), the magnification control detailed in FIG. 10 is executed (S22), ST1 is set 3 (S23), and then the operation goes back to S2. If SW1 is not turned on in S20, whether SW2 is on or not is judged (S24). If so, the operation goes back to S2. If not, ST1 is set 0 (S25), and then the operation goes back to S2.

If ST1=3 in S2, whether SW1 is turned on or not is judged (S30). If so, ST1 is set 1 (S31), and then the operation goes back to S2. If not, whether SW2 is on or not is judged (S32). If so, the operation goes back to S2. If not, the magnification ratio is set 1.0 (S33), the magnification lens 20 is moved to the position corresponding to this ratio (S34), ST1 is set 0 (S35), and then operation goes back to S2.

KEY INPUT ROUTINE

(FIG. 7)

In S300, whether the paper size selection switch SW6 is pushed or not is judged. Since the lower cassette 11 is selected in the initialization, the selected cassette is switched upper or lower each time SW6 is pushed. If SW6 is pushed in S300, whether flag P=1 or not is judged (S301). If so, flag P←0 (S302). If flag P=0 in S301, flag P←1 (S304).

After S302, the paper size detection sensor 61 detects the size of the paper in the cassette 11 (S303). In other words, the paper size detection sensor 61 reads the code F on the cassette 11, and this code is sent to the CPU 50. The ROM 51 has a conversion table showing the relationship between the codes F and the paper lengths. The CPU 50, referring to the above conversion table, finds the length of the paper in the cassette 11. Then, this paper length is stored in area PS1 of the RAM 52 as length PS1. Thereafter, the operation goes to S306.

After the operation goes to S304 from S301, the paper size detection sensor 60 detects the size of the paper in the cassette 10 (S305). In other words, the paper size detection sensor 60 reads the code F on the cassette 10, and this code is sent to the CPU 50. The CPU 50, referring to the conversion table of the ROM 51, finds the length of the paper in the cassette 10. Then, this paper length is stored in area PS2 of the RAM 52 as length PS2. Thereafter, the operation goes to S306. If SW6 is not pushed in S300, the operation jumps to S306.

In S306, whether the magnification sub-mode selection switch SW5 is pushed or not is judged. If not, the operation jumps to S311. If so, the magnification sub-mode before SW5 is pushed is found (S307), and that previous sub-mode is changed in either S308, S309 or S310. In other words, if the previous sub-mode is the first one, it is changed to the second (S308). If the previous sub-mode is the second one, it is changed to the third (S309). If the previous sub-mode is the third one, it is changed to the first (S310). After that, the operation which has been executed on the keys other than SW1, SW2, SW5 and SW6 is stored (S311). Then, the operation goes back to the main routine.

PRE-SCANNING CONTROL ROUTINE

(FIG. 8)

In S200, scanning state ST2 is judged. ST2 can be in six states: 0 through 5. The operation goes to S201 when ST2=0, to S210 when ST2=1, to S220 when ST2=2, to S230 when ST2=3, to S240 when ST2=4, and to S250 when ST2=5.

Since ST2=0 in the initialization, the operation goes to S201. In S201, the motor M1 is rotated forward, whereby the scanner 6 is moved in the direction of the arrow b from its home position. ST2 is set 1 (S202), and then goes back to S200.

Figure 9:
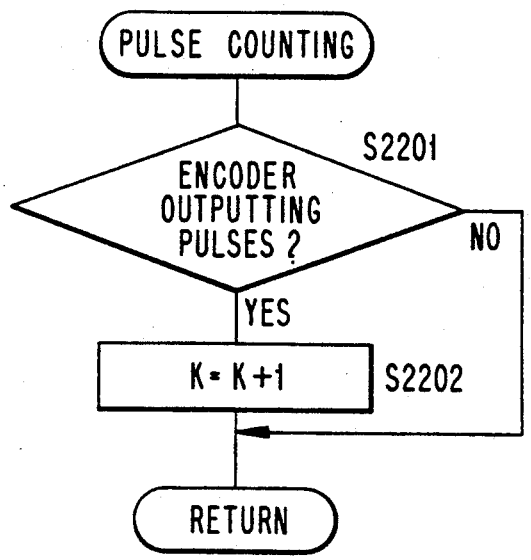
FIG. 9 is a flowchart showing the subroutine of pulse counting.

When ST2=1 in S200, the counting operation is executed (S210). Each time the encoder 44 outputs a pulse signal in accordance with the movement of the scanner 6, the count is incremented one by one (FIG. 9 - S2201, S2202). After the counting is done, whether the first lead switch SW3 is turned on or not is judged (S211). If so, namely, if SW3 detects the permanent magnet 32*a*, the value K when SW3 is turned on is stored in area A of the RAM 52 as value A (S212). After that, ST2 is set 2 (S213), and then the operation goes back to S200.

When ST2=2 in S200, the counting operation is executed (S220), and whether SW3 is turned on or not is judged (S221). If the magnification ratio is less than 1, the second operation member 29 is between the first operation member 28 and the home position of the scanner 6. In this case, the second lead switch SW4 detects the permanent magnet 29*a* earlier than SW3 detects the permanent magnet 28*a*. If the magnification ratio is more than 1, on the other hand, the first operation member 28 is between the second operation member 29 and the home position of the scanner 6. In this case, SW3 detects 28*a* earlier than SW4 detects 29*a*.

If the magnification ratio is less than 1, SW3 is not on in S221. Therefore, whether SW4 is turned on or not is judged (S224). If so, the value K when SW4 is turned on is stored in area B of the RAM 52 as value B (S225). Then, ST2 is set 4 (S226), and then the operation goes back to S200. When ST2=4 in S200, the counting operation is executed (S240). In 241, whether SW3 is turned on or not is judged. If so, the value K when SW3 is turned on is stored in area C of the RAM 52 as value C, the motor M1 is rotated in reverse in order to move the scanner 6 in the opposite direction from the arrow b, and ST2 is set 5 (S242).

If the magnification ratio is more than 1, on the other hand, SW3 is turned on in S221. The value K when SW3 is turned on is stored in area C of the RAM 52 as value C (S222). Then, ST2 is set 3 (S223), and then the operation goes back to S200. When ST2=3 in S200, the counting operation is executed (S230). In S231, whether SW4 is turned on or not is judged. If so, the value K when SW4 is turned on is stored in area B of the RAM 52 as value B, the motor M1 is rotated in reverse in order to move the scanner 6 in the opposite direction from the arrow b, and ST2 is set 5 (S232).

When ST2=5 in S200, whether the permanent magnet HS is detected by SW3 or not is judged (S250). If so, the motor M1 is stopped (S251). If not, the motor M1 keeps on rotating in reverse until HS is detected, namely, until the scanner 6 reaches its home position. After that, X=C−A and Y=B−A (S252), X and Y are converted to the paper lengths (S253), and the value K, areas A, B and C, and ST2 are set 0 (S254). Then, the operation goes to the main routine.

MAGNIFICATION CONTROL ROUTINE (FIG. 10)

When the magnification mode setting switch SW2 is on, the copier 1 is in the magnification mode. In S2200, which magnification sub-mode the copier is in is judged.

If the copier 1 is in the first magnification sub-mode in S2200, the first magnification sub-mode operation is executed (S2210). If the copier 1 is in the second magnification sub-mode in S2200, the second magnification sub-mode operation is executed (S2220). If the copier 1 is in the third magnification sub-mode in S2200, the third magnification sub-mode operation is executed (S2230). After one of the above three operations is finished, the operation goes back to the main routine.

Figure 11:
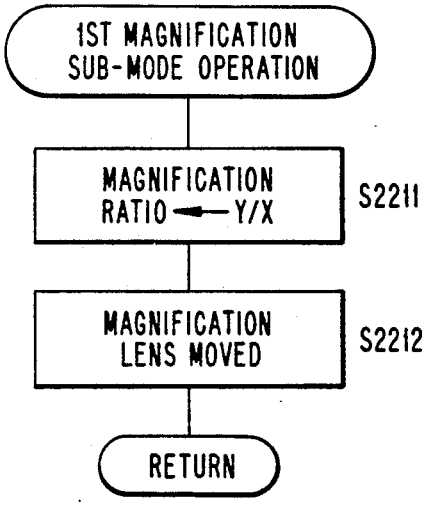
FIG. 11 is a flowchart showing the subroutine of a first magnification sub-mode operation.

1) First magnification sub-mode operation (FIG. 11)

The magnification ratio is set Y/X (S2211), and the magnification lens 20 is moved by the motor M2 in accordance with Y/X in parallel with the scanning direction (S2212). Then operation goes back to the main routine.

In this sub-mode, the magnification ratio is determined by moving the first and the second operation members 28 and 29. This method requires no preparatory calculation, and so is simpler than setting the ratio by key input. The document image area to copy and the duplicated copy size are also visually confirmed, resulting in a copier very easy to use.

Figure 12:
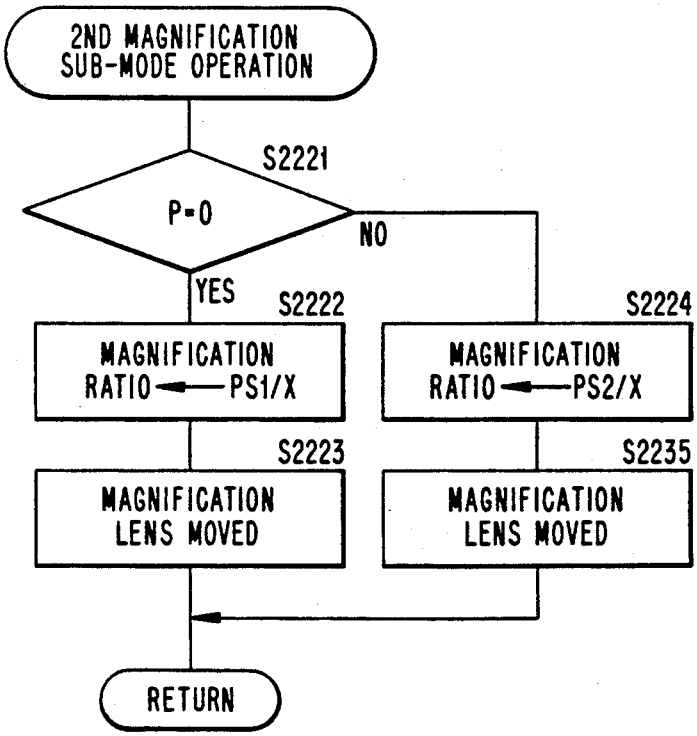
FIG. 12 is a flowchart showing the subroutine of a second magnification sub-mode operation.

2) Second magnification sub-mode operation (FIG. 12)

Which cassette is selected, 10 or 11, is found (S2221). If the lower cassette 11 is selected, namely, if flag P=0, the magnification ratio is set PS1/X (S2222). Then, the motor M2 is driven to move the magnification lens 20 to the position corresponding to the above ratio (S2223). After that, the operation goes back to the main routine.

If the upper cassette 10 is selected, namely, if flag P=1, the magnification ratio is set PS2/X. Then, the motor M2 is driven to move the magnification lens 20 to the position corresponding to the above ratio (S2225). Thereafter, the operation goes back to the main routine.

In this sub-mode, the optimum magnification ratio is obtained by the size of the document image area and the selected paper length. This method enables the document image to be copied with the smallest possible margin.

Figure 13:
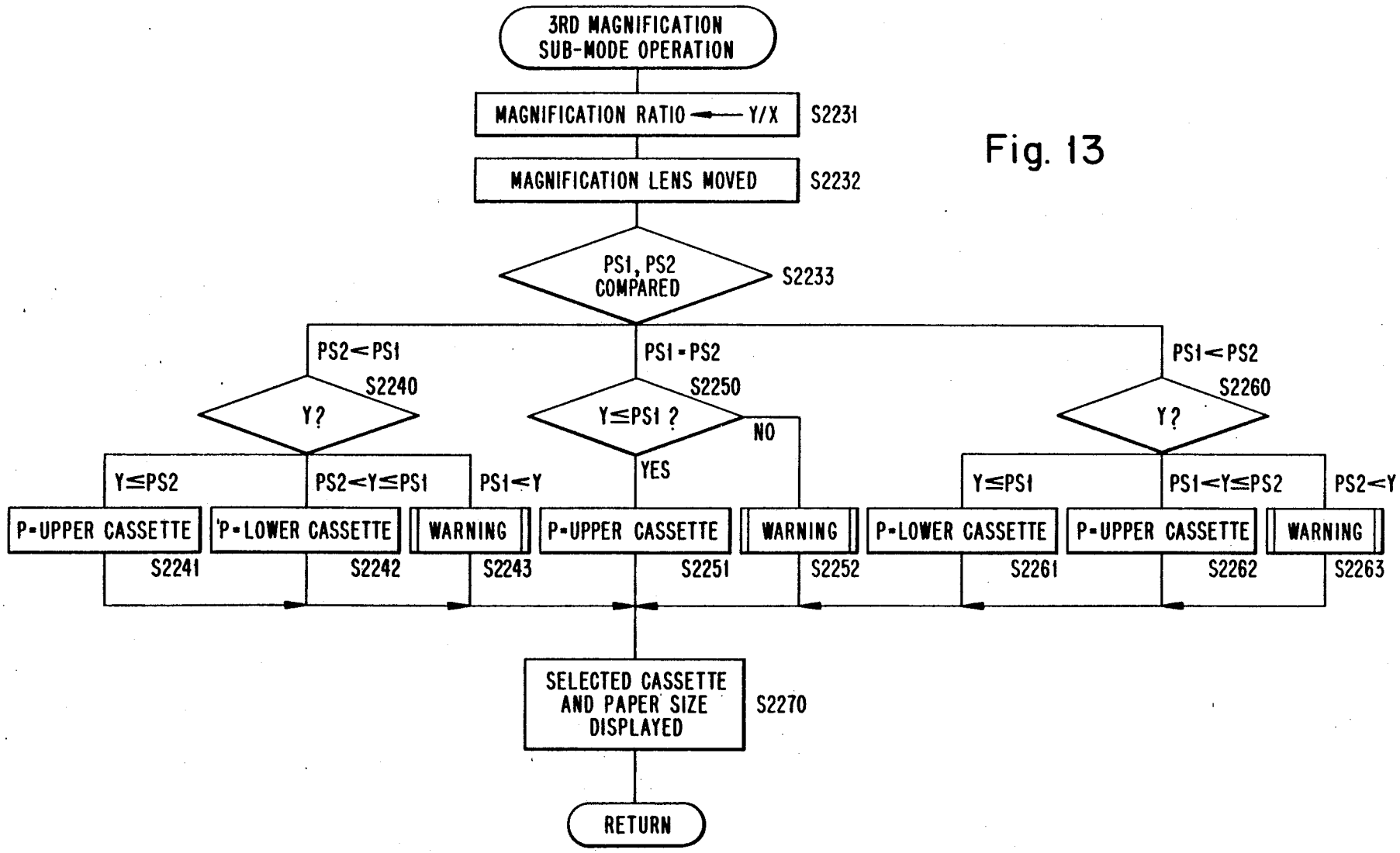
FIG. 13 is a flowchart showing the subroutine of a third magnification sub-mode operation.

3) Third magnification sub-mode operation (FIG. 13)

The magnification ratio is set Y/X (S2231), and the motor M2 is driven to move the magnification lens 20 to the position corresponding to the above ratio (S2232). PS1 and PS2 are compared (S2233). The operation goes to S2240 when PS2<PS1, to S2250 when PS2=PS1, and to S2260 when PS2>PS1.

In S2240, Y, PS1 and PS2 are compared. If Y≦S2, the upper cassette 10 is selected (S2241). If PS2<Y≦PS1, the lower cassette 11 is selected (S2242). If Y>PS1, namely, if the duplicated copy size is bigger than the paper size in either cassette, a warning is displayed in the display window 31 (S2243).

In S2250, whether Y≦PS1 or not is judged. If so, the upper cassettes 10 is selected (S2251). Since the upper and the lower cassette 10 and 11 hold the same size of paper in this case, the lower cassette 11 may be selected. If Y>PS1 in S2250, a warning is displayed (S2252).

In S2260, Y, PS1 and PS2 are compared. If Y≦PS1 the lower cassette 11 is selected (S2261). If PS1<Y≦PS2, the upper cassette 10 is selected (S2262). If PS2<Y, a warning is displayed (S2263).

After the operation is finished in S2241, S2242, S2251, S2261 or S2262, or after an appropriate size of paper is loaded in S2243, S2252 or S2263, the operation goes to S2270, where the selected cassette and its paper size are displayed in the display window 31. Thereafter, the operation goes back to the main routine.

In this sub-mode, the magnification ratio Y/X is determined by moving the first and the second operation members 28 and 29, and the cassette which holds the appropriate size of paper is selected. If the duplicated copy size is bigger than the paper size in either cassette, namely if a part of the document image would not be duplicated on the paper, a warning is displayed so that an appropriate size of paper may be loaded. In consequence, the specified area of the document image is copied with the magnification ratio of Y/X, and the obtained copy has the smallest possible margin.

In the above sub-mode, the duplicated copy size is specified by the second operation member 29, whereby an appropriate size of paper is automatically selected. However, this sub-mode is applicable to another construction where the second operation member 29 is not provided. In such a construction, a magnification ratio is obtained by a separate method of inputting the magnification ratio, and the obtained ratio and the size of the document image area specified by the first operation member 28 are used to find the duplicated copy size.

FIGS. 14*a* through 14*h* show in detail how the image is magnified. Suppose the upper cassette 10 holds a sheet of A3 paper E1, that the lower cassette 11 holds a sheet of B4 paper E2, and that the size of the document D is A3.

Figure 14A:
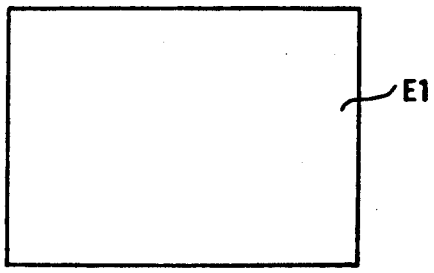
FIGS. 14*a* to 14*h* show how an image is magnified in the first to the third magnification sub-modes.
Figure 14B:
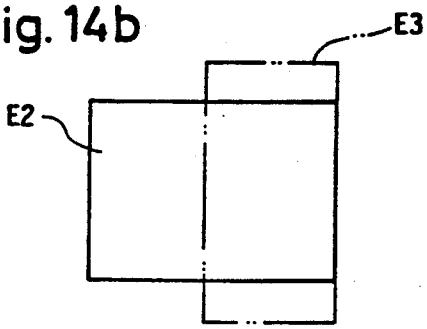
Figure 14C:
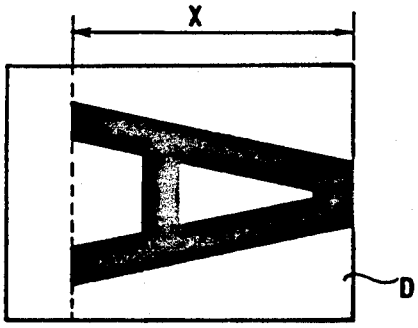
Figure 14D:
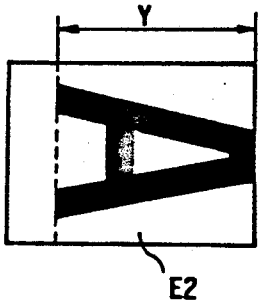
Figure 14E:
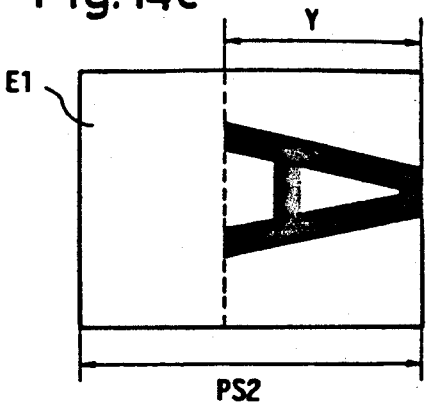

In the first magnification sub-mode, if the lower cassette 11 is selected, the document image is copied on the paper E2 with the magnification ratio of Y/X as shown in FIG. 14*d*. If the upper cassette 10 is selected, the document image is copied on the paper E1 with the magnification ratio of Y/X as shown in FIG. 14*e*.

Figure 14F:
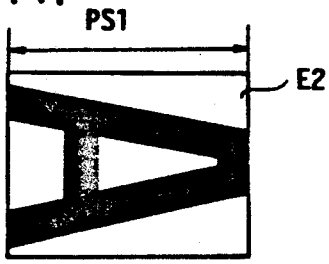
Figure 14G:
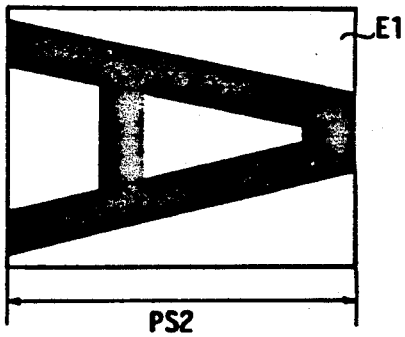

In the second magnification sub-mode, if the lower cassette 11 is selected, the document image is copied on the paper E2 with the magnification ratio of PS1/X as shown in FIG. 14*f*. If the upper cassette 10 is selected, the document image is copied on the paper E1 with the magnification ratio of PS2/X as shown in FIG. 14*g*.

Figure 14H:
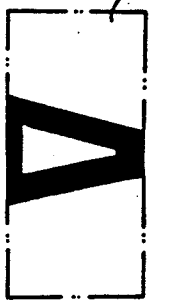

In the third magnification sub-mode, the more appropriate size of paper, E1 or E2, is selected irrespective of the selection of the paper size selection switch SW6. Since Y<PS1 in this embodiment, the lower cassette 11 is selected. The document image is copied on the paper E2 with the magnification, ratio of Y/X as shown in FIG. 14*d*. The margin is smaller in FIG. 14*d* than in FIG. 14*e* where the document image is copied on the paper E1 with the same magnification ratio. If the paper is arranged as shown with E3 of FIG. 14*b* in the cassette 10 or 11, the document image copied with the magnification ratio of Y/X will have a part thereof missing as shown in FIG. 14*h*. In such a case, a warning is displayed in the display window 31.

In the above embodiment, the document is magnified both in the main and the sub scanning directions. However, the magnification method may also be applied for anamorphic copying, where the document image is magnified only in the main scanning direction. In this case, the magnification lens 20 is moved, but the scanning speed of the scanner 6 is the same as that of equal-size copying.

Although the above embodiment employs permanent magnets and lead switches to determine the magnification ratio, such mechanical switches as limit switches or optical switches equipped with light emitting and the light receiving elements may also be used.

In the above embodiment, the magnification mode setting switch SW2 is operated before the first and the second operation members 28 and 29 are. However, another construction may also be applied where 28 and 29 are operated before SW2 is.

Although the copier 1 in the above embodiment is of the slit-exposure type, this invention may also be applied for copiers and printers in which such line image sensors as CCD are used to read an image and a laser optical system is driven. In this case, the document image and the magnification ratio are simultaneouly read, and the laser emitting is controlled in accordance with the magnification ratio.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus comprising:

a rectangular document table, first specifying means, which is movable in parallel with one side of said document table to an arbitrary position, for specifying a position, second specifying means, which is movable in parallel with the same side of said document table to an arbitrary position, for specifying a position representative of a portion of an area on a paper onto which an image of the document is to be formed, first signal generating means for generating a first signal corresponding to the position of said first specifying means, second signal generating means for generating a second signal corresponding to the position of said second specifying means, computing means for computing a copy ratio based on the first and the second signals, a plurality of paper feeding means, selecting means for selecting one of said paper feeding means based on the second signal, and image forming means for forming an image corresponding to a document onto the paper fed from the selected paper feeding means with the above copy ratio.

2. A copying apparatus claimed in claim 1, wherein:

said first specifying means has a first magnet, said second specifying means has a second magnet, said first signal generating means has a first detecting element for detecting the first magnet and generates the first signal based on the output from the first detecting element, and said second signal generating means has a second detecting element for detecting the second magnet and generates the second signal based on the output from the second detecting element.

3. A copying apparatus as claimed in claim 1, further comprising warning means for warning that the size of the area which the document image is to be copied into is bigger than the size of the paper in any of the paper feeding means.

4. A copy apparatus as claimed in claim 1, further comprising:

scanning means for scanning an area of a document specified by said first specifying means, detecting means, movably incorporated with said scanning means, for detecting the positions of said first and second specifying means, and wherein said image forming means forms an image corresponding to the document scanned by said scanning means on the paper fed from the selected paper feeding means with the computed copy ratio.

5. A copy apparatus as claimed in claim 4, further comprising warning means for warning that the size of the area which the document image is to be copied into is bigger than the size of the paper in any of the paper feeding means.

* * * * *